United States Patent [19]

Desaleux et al.

[11] 4,370,993

[45] Feb. 1, 1983

[54] DISPOSABLE UMBRELLA

[75] Inventors: Jean Desaleux, 181 Rue du Faubourg Saint-Honore, 75008 Paris, France; Christian D'Artois, Paris, France

[73] Assignee: Jean Desaleux, Paris, France

[21] Appl. No.: 227,032

[22] Filed: Jan. 21, 1981

[30] Foreign Application Priority Data

Jan. 23, 1980 [FR] France ..... 80 01437

[51] Int. Cl.[3] ..... A45B 13/00

[52] U.S. Cl. ..... 135/19.5

[58] Field of Search ..... 135/19.5, 20 R

[56] References Cited

U.S. PATENT DOCUMENTS

| | | | |
|---|---|---|---|
| 1,752,821 | 4/1930 | Timblin | 135/19.5 |
| 1,924,427 | 8/1933 | Williams | 135/19.5 X |
| 2,385,937 | 10/1945 | Piechowski | 135/19.5 |
| 3,205,904 | 9/1965 | Kreachbaum | 135/19.5 |

FOREIGN PATENT DOCUMENTS

| | | | |
|---|---|---|---|
| 33464 | 8/1981 | European Pat. Off. | 135/20 R |
| 440064 | 10/1948 | Italy | 135/19.5 |
| 7607179 | 1/1977 | Netherlands | 135/19.5 |

*Primary Examiner*—Harland S. Skogquist

*Attorney, Agent, or Firm*—Beveridge, DeGrandi & Kline

[57] ABSTRACT

Cheap umbrella for a limited number of utilizations. Its canopy (1) is formed from a roughly rectangular blank provided with parallel folding lines for folding alternately inwards (3) and outwards (4), bounding pleats (5) between them of constant width except for the end flanges (6) which are narrower than this width and a center rectangular area (2) the width of which amounts to more than twice the width of one pleat (5). The parts acting as forks are formed by two flat vanes (18) of cardboard or similar material shaped like a half-oval hinging on fastening and hinge pieces (16) on the slide (15) and also hinging in the said glued flanges (6), and by two tabs (20) hinging through two transverse grooves (21, 22) and fastened on the slide (15) and on the inner face of the center rectangular panels (2).

10 Claims, 11 Drawing Figures

FIG.1
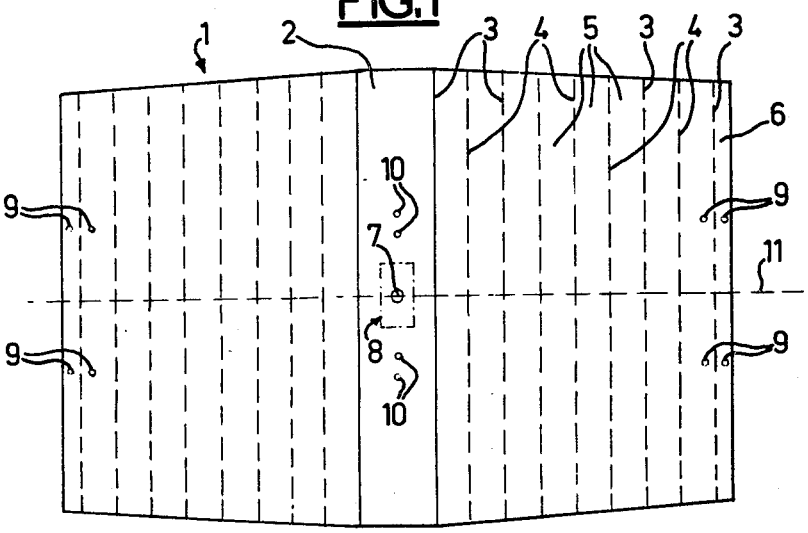
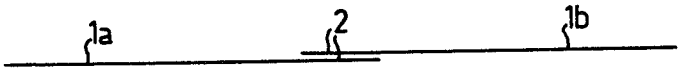
FIG.2
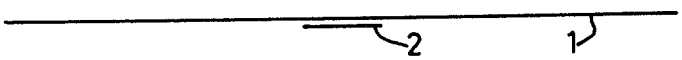
FIG.3
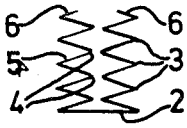
FIG.4
FIG.6
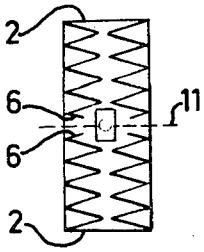
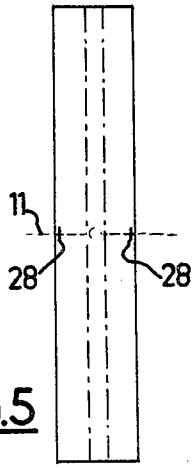
FIG.5
FIG.11
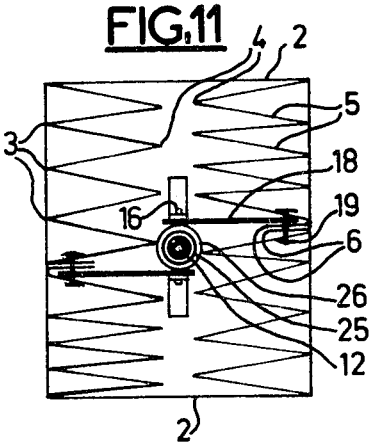

DISPOSABLE UMBRELLA

The invention involves umbrellas or parasols which are of a cheap enough type to be considered as a consumable product, used in an emergency and capable of being thrown away after use or after a limited number of utilizations, without this latter characteristic forming a limitation in itself.

Most known umbrellas are made with fabrics and steel ribs and form cumbersome objects which are also expensive, owing to the materials used as well as to the many seams and many mechanical joints. Folding models are less bulky but are still expensive.

Obviously, Japanese parasols are known, there being made using cheaper materials, paper with sun-ray folds and arms of split bamboo, but the convergent folds of which are hard to achieve by machine and the innumerable branches of which require considerable labour to produce, which again leads to a cumbersome and costly unit, which, moreover, is delicate and cannot withstand the rain.

The aim of the invention is to eliminate the above drawbacks by making the umbrella in an extremely economical manner.

The invention consists in making the umbrella canopy from a roughly rectangular blank made of a paper or similar sheet, preferably waterproofed, in which the grooves or fold lines alternately inside and outside are made parallel in such a way as to mark out between them pleats of constant width, excepting at each end for an end flange slightly narrower than a pleat and a rectangular centre panel in the middle, preferably strengthened, which is slightly wider than double the width of a pleat, with all these pleats being folded in a zig-zag on either side of the centre panel round the fold lines indicated, the whole unit being then folded round a middle transverse fold line with the two large rectangular faces on the outside so that the two halves of each end flange butt against each other so they can be joined by bonding or welding; the canopy is then fitted with a handle formed by a cardboard tube fitting into a centre opening in the side, with a slide formed by a section of cardboard tubing sliding outside the handle, with two hinges placed on this slide along a line transverse to the handle and perpendicular to the rectangular faces in the folded position, the role of the normal forks being played by two cardboard vanes flat in form and roughly half-oval hinging on the slide round the said hinge points in a plane perpendicular to the said transverse line or axis and also hinging each between two adjacent flange halves and one of the following pleats, as well as by two flat rectangular tabs also of cardboard, one end of which is fixed to the slide by one of the said hinge points and the other end of which is fixed on the inner face of the corresponding rectangular panel, each of these tabs hinging round two fold lines located in its plane.

Other features of the invention will appear in the description to follow of an embodiment taken as an example and shown in the appended drawing, in which:

FIG. 1 shows the developed shape of the original blank;

FIGS. 2 and 3 show schematically horizontal sections of this blank in two different embodiments;

FIG. 4 is a section illustrating the initial folding of the blank;

FIG. 5 is a top view of FIG. 4;

FIG. 6 is an end view of the opening side after folding of the assembly of FIG. 5 along the mid line;

FIG. 11 is a top view of the half-opened umbrella.

Figure 8:
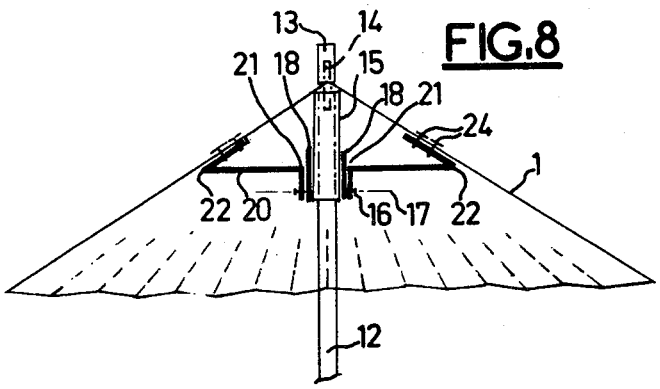
FIG. 8 is a vertical section along VIII—VIII of FIG. 7.

According to the invention the umbrella canopy is made of paper, preferably waterproof, which is stiff enough to avoid the use of arms or ribs. As an example it is possible to use ordinary 120 g/m$^2$ paper coated with a 30 g/m$^2$ layer of polyethylene on the outer face.

With this paper a blank 1 is made with a roughly rectangular outline as shown in FIG. 1. A centre rectangular area 2 is preferably strengthened by gluing on two sheets of the same thickness. This result may be obtained, for example, as illustrated in FIG. 2, by means of two sheets 1*a* and 1*b* the ends of which 2 overlap over the width of the centre area, or again, as shown in FIG. 3, by means of a single sheet 1 onto which a narrow strengthening sheet 2 is applied over the centre area. The solution in FIG. 2 eases machine folding, whilst the solution in FIG. 3 facilitates the application, before or after manufacture of the umbrella, of a decorated part 2 or part used as an advertising medium at the same time as acting as reinforcement. In both cases the whole of the blank thus strengthened will continue to be designated as 1 and the centre panel as 2.

A certain number of parallel grooves or fold lines are made in this blank 1, including the outside fold lines 3, designed to permit the unit to be folded paper on paper, and the inside fold lines 4 designed to permit the unit to be folded polyethylene on polyethylene as is clearly shown in FIG. 4.

These fold lines 3 and 4 are not only parallel but equidistant and allow pleats 5 to remain of constant width and even number, preferably eight, on either side of the centre panel 2, with, in addition, a narrower end flange 6 and, of course, the centre panel 2 which, as can be seen in FIG. 4, is wider than double the width of the pleats 5.

In the centre of the blank 1 a central opening 7 is made with preferably supplementary strengthening 8 formed, for example, by a rectangular sheet of a strong material, paper or fabric, which can advantageously be inserted between the two thicknesses glued together (2 and 2 in FIG. 2 or 1 and 2 in FIG. 3) forming the centre area 2. Finally, perforations 9 and 10 are made in the positions indicated in FIG. 1.

The parallelism of the fold lines 3 and 4 means that the assembly can easily be folded automatically on a paper folding machine to achieve the appearance shown in FIGS. 4 and 5, following which this assembly is itself folded round its mid-line 11 so that the two halves of each flange 6 butt against each other as shown in FIG. 6, with the centre area 2 thus being placed on the outside and folded into two large rectangular faces. This makes it possible to join these two flange halves 6 together on each side by the previous application of a special adhesive for polyethylene or, again, by welding.

The handle 12 formed by a cardboard tube extending up to the strengthening 8 is then fixed in this canopy. A small section 13 of cardboard tubing of the same diameter as the handle 12 is placed above the strengthening 8, and a cylindrical peg 14 in any material fits half-way into each of the tubes 12 and 13 and passes through the perforation 7.

The slide 15 is formed by a section of cardboard tubing, the inside diameter of which is roughly equal to the outside diameter of tube 12, so sliding with slight friction over the latter. At its base this slide has two diametrically opposite holes in which two hinge pieces 16 are placed along the same transverse axis 17. These hinge pieces 16 may, in particular, be formed by connecting pieces of plastics material comprising an integral internal head and an outer counter-head fitting on the previous one by an elastic snap fit. Naturally the internal head of each of the components 16 is held captive between the walls of the cardboard tubes 12 and 15.

Figure 9:
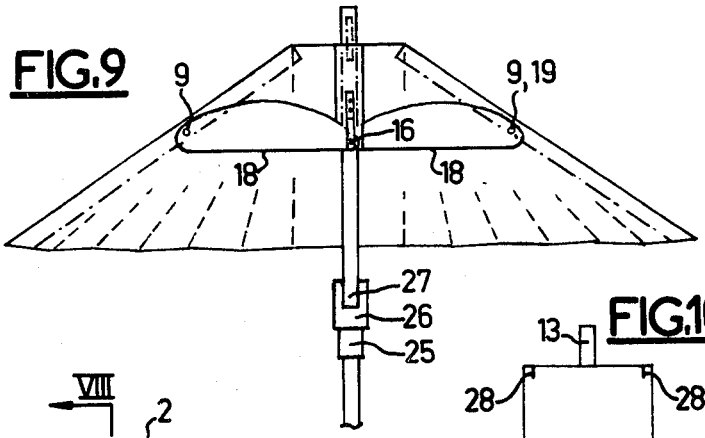
FIG. 9 is a vertical section along IX—IX of FIG. 7.
Figure 7:
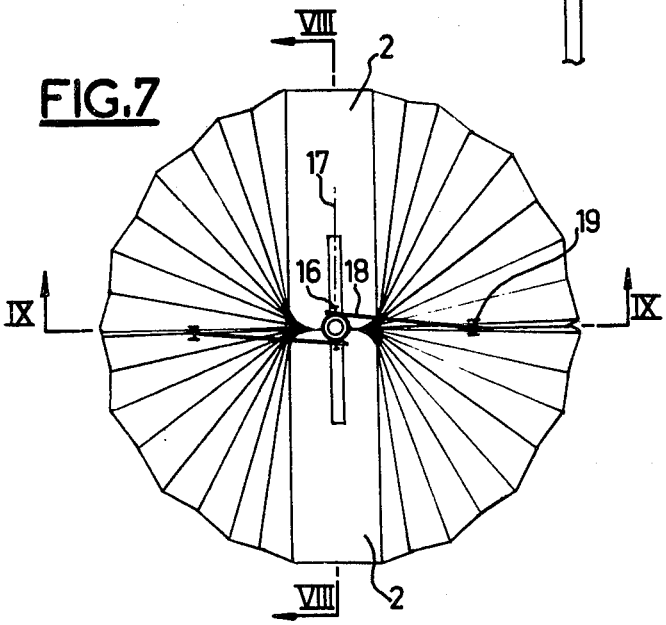
FIG. 7 shows the open umbrella seen from below.

With the transverse axis 17 positioned along the same axial direction as the axis of the two large rectangular faces 2 resulting from folding the initial centre rectangular panel 2 round 11, on each of the fixing pieces 16 is hinged, as shown in FIGS. 7 and 11, the perforated end of a vane 18, preferably shaped like a half-oval as shown in FIG. 9, the other end of which is hinged in perforations 9 by means of another plastic hinge piece 19 similar to 16 and passing both through the two paper thicknesses of the glued flanges 6 and through the two paper thicknesses of the two adjacent pleats 5, as well as through the thickness of the vane 18 placed between one of the flanges and one of the adjacent pleats as shown in FIG. 11. Naturally, each of the vanes 18 is flat and cut out of a sufficiently stiff sheet of cardboard, preferably "porcelain" cardboard.

In addition to the two vanes 18 two rectangular tabs 20 are placed between the slide 15 and the canopy 1; these two tabs 20 are formed, for example, also of "porcelain" cardboard, with two transverse hinge grooves 21 and 22 allowing each tab to be folded in a Z shape as shown in FIG. 8. The inside ends of the tabs 20, i.e. the edges located beyond fold lines 21, have a hole in them allowing them to be joined to the same parts 16 above before fitting elastically onto the corresponding counter-head. The outer edges of the two tabs 20, i.e. the edges located beyond lines 22, are fastened onto the inside face of the rectangular panels 2, for example by means of two elastic snap-fit plastic parts of the above type installed in the previous perforations 10 and in the corresponding perforations of the tabs 20.

The assembly of the two vanes 18 and the two tabs 20 thus forms four hinged links acting like the normal forks of conventional umbrellas, but it should be pointed out that whilst the vanes 18 hinge round the axis 17, i.e. by sliding in their own plane, the tabs 20 hinge round lines 21 and 22, i.e. perpendicularly to line 17, thus leaving their own plane. This makes it possible to gradually push out the canopy in four perpendicular directions, however arranging for each of the two tabs 20 to take up a flat configuration, in the folded position of the umbrella, by fitting exactly between one of the vanes 18 and the corresponding rectangular face 2 which both lie flat against it. This allows the umbrella unit to be folded very flat to a thickness which is virtually no more than the diameter of the slide 15.

The umbrella is opened like a normal umbrella by sliding the slide from the base of the handle until it butts against the strengthening piece 8. In this position, which corresponds to FIGS. 8 and 9, the two hinges 16 and the two hinges 9 on the one hand and, in the perpendicular plane, the four hinges 21 and 22 on the other, are practically in line, which enables the slide to be held in place by the effect of friction alone. It will even be possible to go past the aligned position to achieve a real detent effect by using the elasticity of the canopy paper.

Figure 10:
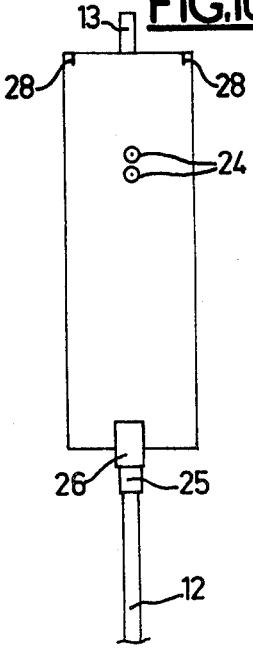
FIG. 10 is an outside view of the umbrella in the closed position.

A further improvement can be achieved by adding onto the handle an extra piece formed by a section of tubing 25 of the same diameter as the tubing forming the slide 15 with, fitted and glued round the it, a section of tubing 26 of slightly larger diameter, with part of the tube 26 protruding above the upper end of the tube 25 being provided with two diametrically opposite rectangular slots 27 which allow the parts of part 26 remaining between the slots 27 to fit onto the base of the tube 15 between the vanes 18. The assembly thus forms a push sleeve providing easier handling and also increasing the friction forces holding the slide 15 in the open position. In addition, in the closed position, this split sleeve can be swivelled through 90° to be positioned as shown in FIG. 10, i.e. so that the base of the two large rectangular faces 2 containing between them all the folds of the canopy, fits into the slots 27, thus holding the umbrella in the closed position for storage, transport and distribution.

Another improvement also, aimed at consolidating the assembly in the open position, notably when the paper is wet, whilst enabling the pleats 5 to make the hinging movement when the umbrella is opened, consists in preferably fitting on the folded blank, in the condition in FIG. 5, two staples 28, one each on the edge of the folds 3 and straddling the transverse line 11, but so that these staples or clips 28 only pass through the panel 2 and the first seven pleats 5 but not the last pleat 5 or the flange 6 in order not to hinder the subsequent gluing of this flange. When the assembly is folded round the fold line 11 is must be checked that the backs of the staples 28 are also folded as shown in FIG. 10.

It should be pointed out that if it is required, when the umbrella is in the open position, as shown in FIGS. 7 to 9, that the canopy base line be roughly circular, flat and horizontal, it is preferable for the outline of the original blank 1 not to be exactly rectangular but to include a slight slope at the four corners as shown in FIG. 1, i.e. for the two folded parts on either side of the original rectangular centre area 2 to be roughly trapezoidal.

All of the canopy and the various accessories can be manufactured speedily and economically using the normal cardboard fabrication machinery and assembly of the parts is very easy owing to the small number of these parts. The assembly thus makes it possible to produce an extremely cheap umbrella or parasol at the same time as still enabling it to be re-folded and re-used a number of times.

We claim:

1. A cheap umbrella for a limited number of utilizations of a type comprising a folded canopy, the opening and closure of which are achieved through parts acting as forks and which are hinged on a slide sliding along a handle, the said canopy being formed from a roughly rectangular blank provided with parallel fold lines, for alternate folding to the inside and the outside, bounding between them pleats of constant width except for the end edges which are narrower than this width, the assembly double folded in zig-zag shape being subsequently folded in two round a transverse mid-line so that the two halves of each end edge butt against each other and are fastened together by bonding or welding, characterized by the fact that the said blank comprises a centre rectangular area (2) located between two successive fold lines (3), both for folding to the inside, the width of which amounts to over twice the width of a standard pleat (5); and that the said parts acting as forks are formed by two flat vanes (18) in cardboard or similar material of half-oval shape hinging on the fastening and hinge pieces (16) of the slide (15) and also hinging in the said glued flanges (6), and through two tabs (20) hinging through two transverse grooves (21, 22) made in each of them and fixed by one of their ends into one of the said fastening and hinge pieces (16) of the slide (15) and by the other end on the inner face of the said centre rectangular panels (2).

2. The umbrella according to claim 1, the slide and handle of which are formed by sections of cardboard tubing sliding over each other, characterized by the fact that it comprises a small section (13) of cardboard tubing of the same diameter as the handle tube (12), which is located above the upper end of the canopy (1) and joined to the handle tube (12) by means of a central peg (14) passing through the canopy (1) via a central opening (7).

3. The umbrella according to claim 1 or 2 characterized by the fact that the various fastenings and hinges of the two ends of the said vanes (18) and of the said tabs (20) are made by means of pieces of plastics material (16, 19, 24) with an integral head and a separate counterhead fitting on with an elastic snap fit.

4. The umbrella according to claim 1 characterized by the fact that the canopy (1) is made of paper coated with plastics material, in particular paper coated wtih polyethylene, and that the centre rectangular area (2) of the blank is reinforced by backing.

5. The umbrella according to claim 4, characterized by the fact that the blank is formed by two identical blanks (1*a*, 1*b*) the edges (2) of which mutually overlap in the centre rectangular area to form the said double layer or backing.

6. The umbrella according to claim 4, characterized by the fact that the blank is in one piece (1) and that the said backing is achieved through a central strengthening piece (2) applied before or after manufacture.

7. The umbrella according to claim 1 characterized by the fact that the outline of the blank (1) on either side of the rectangular centre area (2) is slightly trapezoidal with the short bases turned outwards.

8. The umbrella according to claim 1 characterized by the fact that it also comprises a cardboard sleeve (25, 26) sliding on the handle and provided at its upper end with two rectangular slots (27) so that the sections remaining between the slots may either fit onto the base of the slide (15) or, after being rotated through 90°, fit onto the lower end of the folded canopy (1).

9. The umbrella according to claim 1 characterized by the fact that the said vanes (18) and tabs (20) are made using dense cardboard.

10. The umbrella according to claim 1 characterized by the fact that the canopy (1) comprises a clip (28) on each side passing through the various pleats (5), except for the last one and the corresponding flange (6), and placed astride the middle transverse fold line (11) to be folded at the same time as the whole unit.

* * * * *